US007063442B2

(12) United States Patent
Sugar

(10) Patent No.: US 7,063,442 B2
(45) Date of Patent: Jun. 20, 2006

(54) DECORATIVE LIGHT STRING

(75) Inventor: Michael Sugar, Skokie, IL (US)

(73) Assignee: Inliten, LLC, Northfield, IL (US)

( * ) Notice: Subject to any disclaimer, the term of this patent is extended or adjusted under 35 U.S.C. 154(b) by 0 days.

(21) Appl. No.: 10/875,153

(22) Filed: Jun. 23, 2004

(65) Prior Publication Data

US 2005/0286255 A1 Dec. 29, 2005

(51) Int. Cl.
*F21P 1/00* (2006.01)
*F21V 19/00* (2006.01)

(52) U.S. Cl. ..... 362/252; 362/219; 362/249

(58) Field of Classification Search ..... 362/123, 362/249–251, 252, 554, 238, 239, 219
See application file for complete search history.

(56) References Cited

U.S. PATENT DOCUMENTS

| | | | | |
|---|---|---|---|---|
| 3,723,723 | A | 3/1973 | Lerner | |
| 4,870,547 | A * | 9/1989 | Crucefix | 362/123 |
| 5,150,964 | A | 9/1992 | Tsui | |
| 5,746,504 | A | 5/1998 | Dodson | |
| 5,860,731 | A | 1/1999 | Martinez | |
| 5,893,634 | A * | 4/1999 | Wang | 362/249 |
| 5,915,827 | A * | 6/1999 | Wang | 362/252 |
| 5,967,644 | A | 10/1999 | Pan | |
| 6,027,228 | A | 2/2000 | Adams et al. | |
| 6,050,701 | A * | 4/2000 | Stone | 362/249 |
| 6,086,222 | A | 7/2000 | Juba et al. | |
| 6,152,576 | A | 11/2000 | Mount | |
| 6,210,016 | B1 * | 4/2001 | Prineppi | 362/123 |
| 6,296,374 | B1 * | 10/2001 | Ahroni | 362/252 |
| 6,309,087 | B1 | 10/2001 | Huang | |
| 6,318,884 | B1 * | 11/2001 | Hibbard et al. | 362/391 |
| 6,382,814 | B1 | 5/2002 | Petrocelli | |
| 6,394,623 | B1 * | 5/2002 | Tsui | 362/249 |
| 6,398,387 | B1 | 6/2002 | Wienhold | |
| 6,474,841 | B1 | 11/2002 | Rahman | |
| 6,739,745 | B1 * | 5/2004 | Valdes | 362/554 |

* cited by examiner

*Primary Examiner*—Stephen Husar
*Assistant Examiner*—James W Cranson, Jr.
(74) *Attorney, Agent, or Firm*—Michael Best & Friedrich LLP

(57) ABSTRACT

A decorative light string including a plurality of first and second lights is provided. The first lights are distributed along the length of the light string and are spaced apart by a first predetermined distance. The second lights are arranged in a plurality of drops, and each drop is retained in alignment with one of the plurality of fist lights by a coupling means. In one exemplary embodiment, the decorative light string comprises a first light string including electrically parallel-connected C-type lights, a second light string including electrically series-connected mini lights arranged in drops, and a plurality of connectors for coupling the first and second light strings together.

25 Claims, 2 Drawing Sheets

DECORATIVE LIGHT STRING

FIELD OF THE INVENTION

This invention pertains to lighting apparatus, and more particularly to light strings.

BACKGROUND OF THE INVENTION

Decorative lighting is known for use at homes and businesses to achieve a desired architectural or visual effect. Decorative light strings are one type of well known decorative lighting that is particularly popular for use around the fall and wintertime holidays. Many individuals believe that there's nothing like a cheerful string of lights to foster the holiday spirit. Bright, twinkling, and/or flashing lights, both inside and outside, are one of the joys and traditions of the holiday season. One type of light string that is commonly known as C-sets in the art, includes a plurality of parallel connected bulb sockets that accept generally cone-shaped C-shaped (e.g., C6, C7, Intermediate Base, C9, Candelabra Base, etc.), G-shaped globe bulbs, or other suitable bulbs of one or more colors. When installed on a home, building, or other structure, C-sets are known for providing a holiday visual effect akin to a decorated gingerbread house, and therefore are desirable to traditionalist holiday decorators.

More recently, another type of light string, which has become increasingly popular, is commonly known as icicle light strings, or more commonly known as icicle lights. Icicle lights typically include a plurality of series connected "mini" bulbs (i.e., 2.5 volt bulbs) arranged on a number of conductors that extend generally transverse to a mainline conductor. These transversely extending conductors, which emulate the visual effect of hanging icicles, are known as drops in the art. Although such icicle lights have become quite popular, the foregoing traditionalist holiday decorators have been somewhat reluctant to adopt icicle lights in conjunction with the foregoing C-sets for various reasons including, but not limited to, the amount of work required to hang two separate light strings, the difficulty in preventing the two separate light strings from becoming entangled during hanging and storage, and the difficulty in aligning the c-set and icicle lights to achieve a desired visual effect.

One product attempting to obviate the traditionalists' reluctance to purchase and install icicle lighting is a c-bulb shaped cover for a mini light. The generally translucent or transparent cover is installed on one or more mini lights of an icicle light string to provide a more traditional visual effect, or a combination effect. Since the light output from a mini light is typically less than the light output from a C-type bulb, the use of such covers further dims the light output of the mini light onto which they are installed, and does not provide a suitable visual effect. In view of the foregoing, a light string providing a desirable combination lighting effect would be welcome.

BRIEF SUMMARY OF THE INVENTION

The invention provides a decorative light string including a plurality of first and second lights. The first lights are distributed along the length of the light string and are spaced apart by a first predetermined distance. The second lights are arranged in a plurality of drops, and each drop is retained in alignment with one of the plurality of first lights by a coupling means. In one exemplary embodiment, the decorative light string comprises a first light string including electrically parallel-connected C-type lights, a second light string including electrically series-connected mini lights arranged in drops, and a plurality of connectors for coupling the first and second light strings together. The C-type lights are spaced apart from each other on the first light string by a first predetermined distance, and the drops of the second light string are spaced apart from each other by a second predetermined distance, which may be equal to the first predetermined distance. In other embodiments, the second predetermined distance is selected to be an integer multiple of the first predetermined distance. The plurality of connectors are disposed along the first and second light strings proximate to the first lights and drops to facilitate the appearance of a single light string and obviate mis-alignment of the first lights and drops.

DETAILED DESCRIPTION OF THE EXEMPLARY EMBODIMENTS

Figure 1:
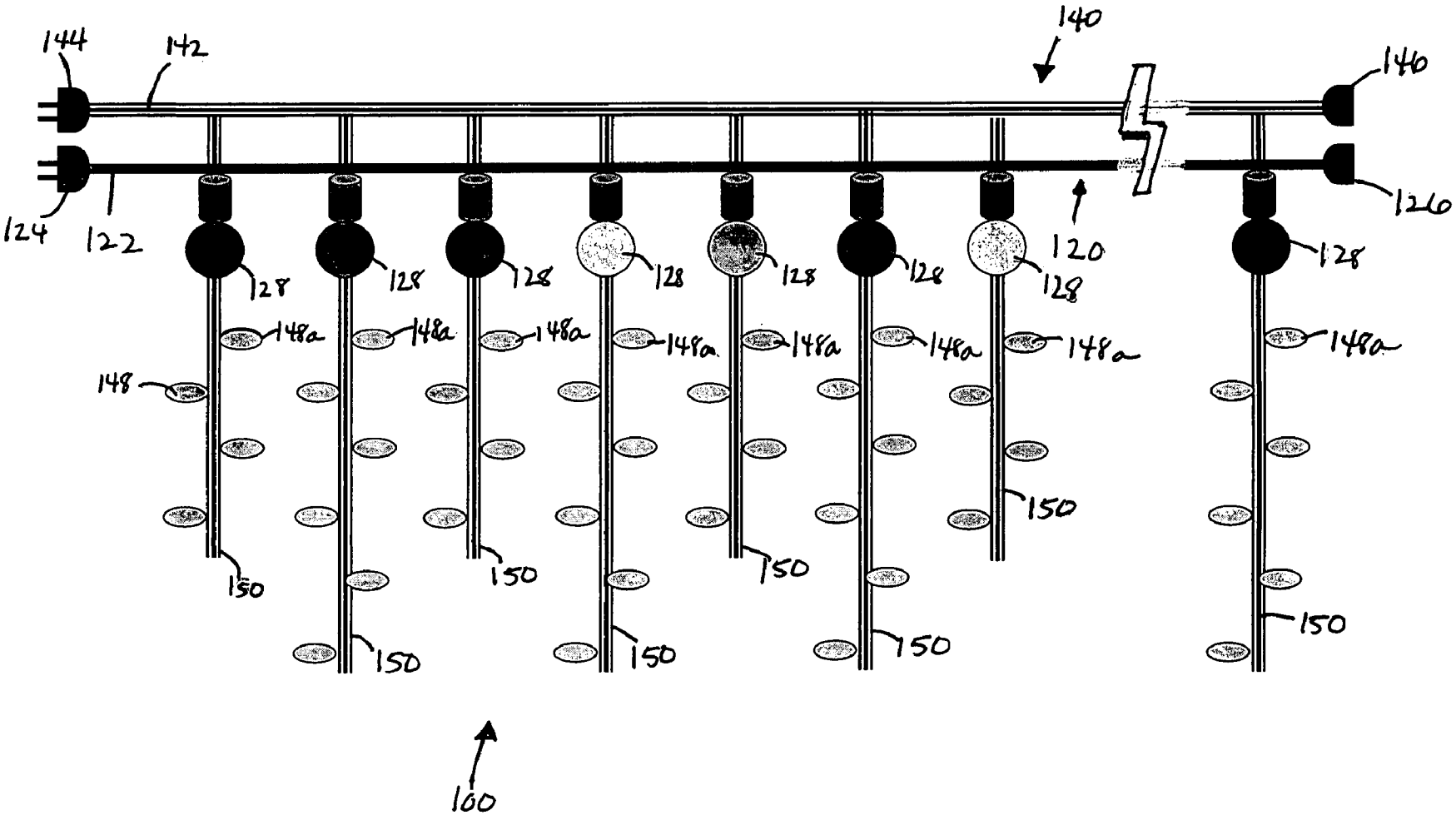
FIG. 1 illustrates an exemplary decorative light string.

In accordance with the figures, and particularly FIG. 1, a decorative light string is described. One exemplary embodiment of the subject decorative light string is available from the Applicant's Assignee under the product name "C-cicles". As shown in FIG. 1, the decorative light string 100 includes a first light string 120 and a second light string 140. The first light string 120 includes a first mainline conductor 122 with a first end terminated in a first plug 124, and a second end terminated in a first end connector 126. As is known, the plug 124 includes blades that are sized and shaped for insertion into a typical 120 volt, alternating current outlet. The plug 124 may also include a protection means such as a fuse, resettable breaker, or the like for preventing damage to the string 120 due to overcurrent and/or faults. The first end connector 126 includes blade receiving slots for electrically energizing another first light string 120, thereby extending the length of the first light string's visual effect. Alternatively, other suitable light strings, decorations, or the like may be energized from the connector 126. Further, as known in the art, the plug 124 and/or the connector 126 may be of the polarized type with one blade or slot wider than the other.

As shown in FIG. 1, a plurality of first lights 128 are electrically connected to the first conductor 122. The first light 128 comprises a bulb, and a socket adapted to receive and energize said bulb. The bulbs may be any suitable incandescent, fluorescent, LED, or other light-emitting means as known in the art. In an exemplary embodiment, the bulbs are generally cone-shaped C-type bulbs (e.g., C6, C7, C9) that are known in the art, and the sockets are connected to the first conductor 122 such that they are electrically parallel. The bulbs may be clear (i.e., transparent or translucent), ceramic, colored, or any combination thereof. In addition, one or more of the bulbs may be "twinkle" or "flashing" bulbs as known in the art for producing a desired visual effect from the plurality of first lights 128.

The first lights 128 are distributed along at least a portion of the length of the first conductor 122, such that adjacent first lights 128 of the plurality are separated by a first predetermined distance therebetween. Additionally, portions of the first conductor 122 may be unlit (e.g., portions proximate the first plug 124 and proximate the first end connector 126) to facilitate connection of the first light string 120 to an outlet or another light string. For example, in one embodiment, the total length of the first light string 120 may be ten and a half feet wherein the first light string 120 includes twenty lights 128 that are spaced apart from each other by approximately six inches, thereby providing a lighted portion of conductor 122 approximately nine and a half feet in length and an unlit portion of conductor 122 approximately one foot in length. The unlit portion may be distributed as approximately six inches proximate the first plug 124 and six inches proximate first end connector 126 or other suitable distribution.

Similar to the first light string 120 described above, the second light string 140 includes a second mainline conductor 142, with a first end terminated in a second plug 144, and a second end terminated in a second end connector 146. As is known, the plug 144 includes blades that are sized and shaped for insertion into a typical 120 volt, alternating current outlet. The plug 144 may also include a protection means such as a fuse, resettable breaker, or the like for preventing damage to the string 140 due to overcurrent and/or faults. The first end connector 146 includes blade receiving slots for electrically energizing another second light string 140, thereby extending the length of the second light string's visual effect. Alternatively, other suitable light strings, decorations, or the like may be energized from the connector 146. Further, as known in the art, the plug 144 and/or the connector 146 may be of the polarized type with one blade or slot wider than the other.

The second light string 140 includes a plurality of second lights 148 that are electrically connected to the second conductor 142. As illustrated in FIG. 1, the plurality of second lights 148 are arranged on a plurality of drops 150 that are electrically connected to the second conductor 142 and extending generally transversely therefrom. As shown, the drops 150 may be of varying (FIG. 1) or equal (FIG. 2) length to achieve a desired visual effect. The second light 148 comprises a bulb, and a socket adapted to receive and energize said bulb. The bulbs may be any suitable incandescent, fluorescent, LED, or other light-emitting means as known in the art. In an exemplary embodiment, the bulbs are known in the art as "mini" lights, and the sockets are connected to the second conductor 142 such that the sockets of each drop are electrically in series. Additionally, one or more drops 150 may be electrically coupled to the conductor 142 such that they are in parallel. In this way, if one or more second lights 148 were to burn out, break, malfunction, or the like, the likelihood of the second string 140 completely going dark is minimized. The bulbs may be clear (i.e., transparent or translucent), ceramic, colored, or any combination thereof. In addition, one or more of the bulbs may be "twinkle" or "flashing" bulbs as known in the art for producing a desired visual effect from the plurality of second lights 148. The second lights 148 may be the same as the first lights 128 in some instances, however a more desirable visual effect may be achieved if the lights 128, 148 are selected to be different.

The plurality of drops 150 are distributed along at least a portion of the length of the second conductor 142, such that adjacent drops 150 of the plurality are separated by a second predetermined distance therebetween. Additionally, portions of the second conductor 142 may be unlit (e.g., portions proximate the second plug 144 and proximate the second end connector 146) to facilitate connection of the second light string 140 to an outlet or another light string. For example, in one embodiment, the total length of the second light string 140 may be ten and a half feet wherein the second light string 140 includes twenty drops 150 that are spaced apart from each other by approximately six inches, thereby providing a lighted portion of conductor 142 approximately nine and a half feet in length and an unlit portion of conductor 142 approximately one foot in length. The unlit portion may be distributed as approximately six inches proximate the second plug 144 and six inches proximate second end connector 146, or other suitable distribution. Moreover, the second lights 148 are distributed along the length of each drop 150. As shown in FIG. 1, the top-most second light 148a of each drop 150 is spaced away from the conductor 142. Continuing along the drop 150 from the top-most second light 148*a*, the remaining plurality of second lights 148 on the drop 150 may be spaced apart from each other by a third predetermined distance. In one embodiment, wherein the conductor 142 is connected to a building or other structure, the top-most second lights 148*a* are spaced away from the conductor 142 approximately four and a half inches, and the remaining second lights 148 are equally space apart by three inches such that each drop 150 provides the visual appearance of a downward hanging icicle. The spacing from the conductor 142 to the top-most second lights 148*a* should be such that the top-most second lights 148*a* are not visually obstructed by the first lights 128, which may include globe-shaped or long bulbs (e.g., fiesta, flame-tip, torpedo, etc.).

Figure 2:
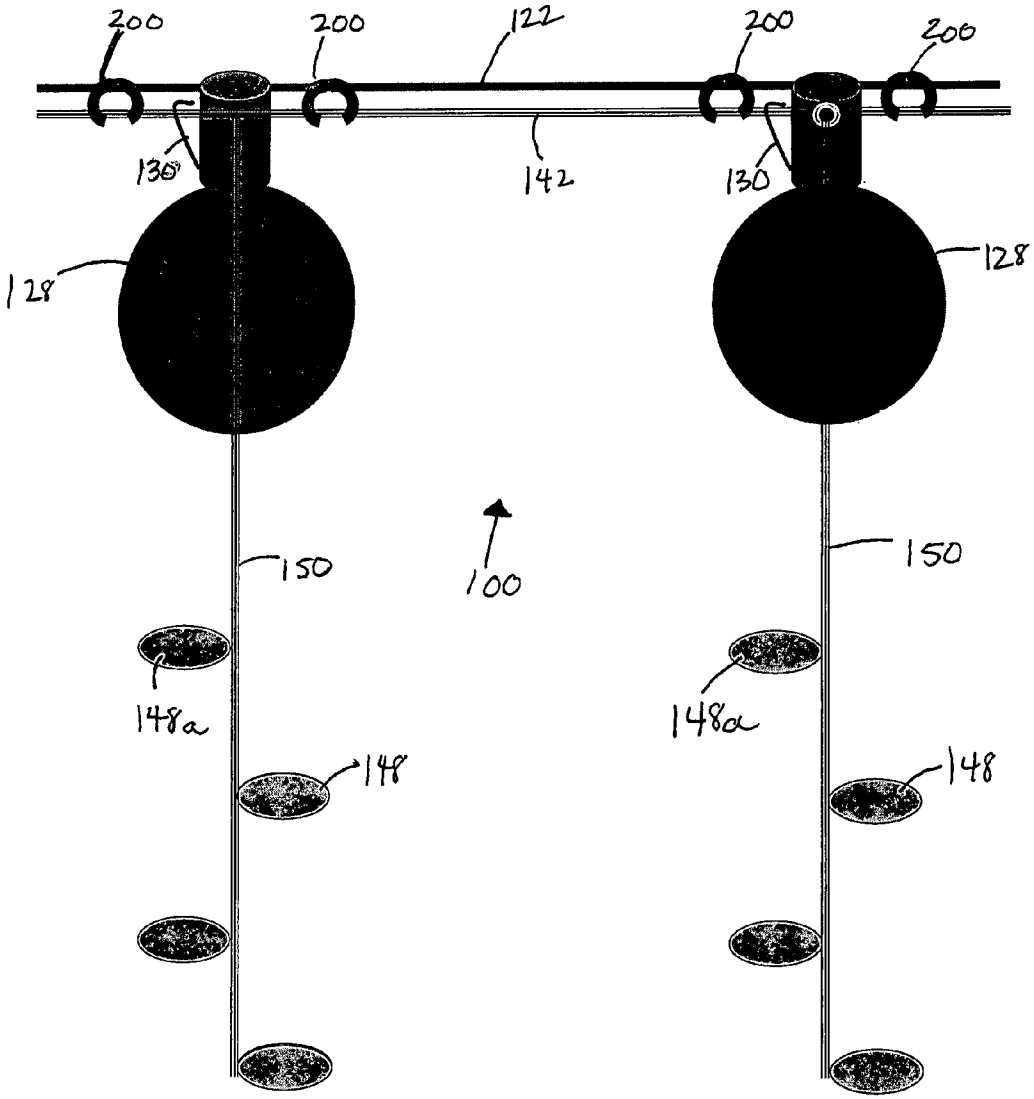
FIG. 2 illustrates a rear close-up detail view of a portion of the exemplary decorative light string of FIG. 1.

Referring now to FIG. 2, the light string 100 is described in further detail. As shown, the first and second strings 120, 140 are provided and conductors 122, 142 are arranged such that they are generally parallel and alongside each other to provide the visual appearance of a single conductor and light string. The conductors 122, 142 are coupled together by a coupling means. As illustrated in an exemplary embodiment of FIG. 2, the coupling means may comprise a plurality of connectors 200 disposed along the length of the light string 100. The connectors 200 may be permanently or removably installed on the light string 100. As shown in the illustrated embodiment of FIG. 2, the connectors may be snap-fit, friction-fit, or otherwise openable and closable to facilitate adjustment of the alignment of the strings 120, 140, or alternatively to facilitate repair or replacement of either string 120, 140. The connectors 200 are operative to frictionally bind the conductors 122, 142 together and obviate accidental separation and misalignment of the strings 120, 140. The connectors 200 are sized and shaped to accommodate the conductors 122, 142 and inhibit sliding therethrough without unduly compressing the jacket or insulation of the conductors 122, 142. The connectors 200 may be plastic or another suitable material that is durable, weather-resistant, and non-chafing to the conductors 122, 142. As shown in FIG. 2, at least two connectors 200 of the plurality of connectors are arranged on either side of each first light 128 and drop 150. Thus, having flanked each first light 128 and drop 150 by at least two connectors 200, the drop 150 and first light 128 are retained in substantial alignment with each other. The light string 100 may be hung using clips 130, which may be integral with the first light's sockets, such that the drops 150 are generally behind or not obstructing the view of the first lights 128. When hung or otherwise installed in this manner on a structure, such as a gutter, for example, the visual effect of light string 100 gives the illusion that the first light 128 melts the adjacent snow such that an icicle (i.e., drop 150) originates therefrom, and extends generally downward.

Although FIGS. 1 and 2 illustrate one embodiment of the light string 100 having equal quantities of first lights 128 and drops 150 (i.e., consequently the first and second predetermined distances are equal), the light sting 100 is not limited to such an arrangement. To achieve other desirable visual effects, in some alternative embodiments the second predetermined distance (i.e., the spacing between the drops 150) may be a non-unitary, positive integer multiple of the first predetermined distance (i.e., the spacing between the first lights 128). For example, if a multiple of two were selected, the drops 150 may align with every other first light 128; if a multiple of three were selected, the drops 150 may align with every third first light 128, and so on. In other alternative embodiments the second predetennined distance may be a positive fractional or decimal number between zero and one to provide for one or more drops 150 between adjacent first lights 128. For example, if a multiple of ½ were selected, the drops 150 may align with each first light 128 and provide for one drop 150 equally spaced between adjacent first lights 128, and so on.

Moreover, alternative embodiments of the light string 100 may include light strings other than those C-sets and icicle lights discussed above. For example, one of the first or second strings 120, 140 may be or include one or more rope lights. In another example, one of the first or second strings 120, 140 may be or include one or more light pipes. In addition to the foregoing, the light string 100 may include or be operable with a controller, such as an IC controller, for facilitating various visual effects such as blinking, flashing, chasing, and the like.

Exemplary embodiments of this invention are described herein. Variations of those embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A light string comprising:

a first conductor;

a plurality of first light bulb sockets coupled with the first conductor;

a second conductor;

a plurality of drops coupled with the second conductor, each drop of the plurality including second light bulb sockets; and a coupling means operative to retain each drop in alignment with one of the plurality of first light bulb sockets.

2. The light string of claim 1 wherein the plurality of first light bulb sockets comprise parallel-connected light bulb sockets.

3. The light string of claim 2 wherein the parallel-connected light bulb sockets are configured to receive lights selected from the group consisting essentially of C7 bulbs, C9 bulbs and Edison-type bulbs.

4. The light string of claim 1 wherein the second light bulb sockets comprise series-connected light bulb sockets.

5. The light string of claim 4 wherein the series-connected light bulb sockets are configured to receive mini bulbs.

6. The light string of claim 1 wherein the first light bulb sockets are spaced apart from each other along the string by a first predetermined distance.

7. The light string of claim 6 wherein the drops are spaced apart from each other along the string by a second predetermined distance.

8. The light string of claim 7 wherein the first and second predetermined distances are equal.

9. The light string of claim 7 wherein the second predetermined distance is the first predetermined distance multiplied by a positive integer.

10. The light string of claim 1 wherein the coupling means comprises a plurality of connectors.

11. The light string of claim 10 wherein the plurality of connectors are distributed along the string and at least one connector is oriented proximate each drop.

12. A decorative light apparatus comprising:

a first light string comprising:

a first conductor; and at least two first lights connected to the first conductor and spaced apart by a first predetermined distance;

a second light string comprising:

a second conductor;

at least two drops connected to the second conductor and spaced apart by a second predetermined distance; and a plurality of connectors operative to couple the first and second light strings.

13. The decorative light apparatus of claim 12 wherein the drops further comprise a plurality of second lights.

14. The decorative light apparatus of claim 13 wherein the plurality of second lights comprise series connected mini lights.

15. The decorative light apparatus of claim 12 wherein the first lights are selected from the group consisting essentially of C7, C9 and Edison-type bulbs.

16. The decorative light apparatus of claim 12 wherein the first and second conductors each further comprise an end connector.

17. The decorative light apparatus of claim 12 wherein the first and second predetermined distances are equal.

18. The decorative light apparatus of claim 17 wherein at least two connectors of the plurality of connectors flank each of the at least two first lights to inhibit the at least two drops from becoming misaligned with the at least two first lights.

19. A combination light string comprising:

a first light string:

a second light string; wherein one of the first or second light string comprises a C-set; and a connecting means for coupling the first and second light strings together so that the first and second light strings provide the visual appearance of a single light string.

20. A combination light string comprising:

a first light string, a second light string; wherein one of the first or second light string comprises an icicle light set; and a connecting means for coupling the first and second light strings together so that the first and second light strings provide the visual appearance of a single light string.

21. A decorative light apparatus comprising:

a first light string comprising:

a first conductor; and at least two first light bulb sockets connected to the first conductor and spaced apart by a first predetermined distance;

a second light string comprising:

a second conductor;

at least two drops connected to the second conductor and spaced apart by a second predetermined distance; and a plurality of connectors operative to couple the first and second light strings.

22. The decorative light apparatus of claim 21 wherein the at least two first light bulb sockets are configured to receive first lights selected from the group consisting essentially of C7, C9 and Edison-type bulbs.

23. The decorative light apparatus of claim 22 wherein at least two connectors of the plurality of connectors flank each of the at least two first light bulb sockets to inhibit the at least two drops from becoming misaligned with the first lights.

24. The decorative light apparatus of claim 21 wherein the drops further comprise a plurality of second lights bulb sockets.

25. The decorative light apparatus of claim 24 wherein the plurality of second light bulb sockets are configured to receive series connected mini lights.

* * * * *